United States Patent [19]

Sims et al.

[11] 4,176,492

[45] Dec. 4, 1979

[54] MAGNETIZED TOY WITH REMOVABLE APPENDAGES

[75] Inventors: Anson Sims, Granada Hills; Lawrence T. Jones, Playa Del Rey, both of Calif.

[73] Assignee: California R & D Center, Culver City, Calif.

[21] Appl. No.: 863,931

[22] Filed: Dec. 23, 1977

[51] Int. Cl.[2] ..... A63H 3/10

[52] U.S. Cl. ..... 46/22; 46/119; 46/241

[58] Field of Search ..... 46/22, 236, 237, 241, 46/119

[56] References Cited

U.S. PATENT DOCUMENTS

| | | | |
|---|---|---|---|
| 3,068,615 | 12/1962 | Nassour | 46/22 |
| 3,401,485 | 9/1968 | Goodrum | 46/22 |
| 4,038,775 | 8/1977 | Sato | 46/22 |

*Primary Examiner*—Louis G. Mancene
*Assistant Examiner*—Robert F. Cutting
*Attorney, Agent, or Firm*—Jackson, Jones & Price

[57] ABSTRACT

An articulated magnetized toy having removable appendages is provided for young children. A body member can be subjectively configured to simulate the body of a humanoid, animal, vehicle, etc. The body member contains at least one magnet and armature plates for removably retaining one or more articulated appendages. Preferably, the side surfaces of the body member are flat and parallel. An articulated appendage has a U-shaped configuration which includes a base member and pair of upright members extending on either side of the housing member. The upright members can be configured and positioned on the body member to represent legs or arms. A spherical joint is mounted on the base member for interconnection with arcuate joints on the armature plates.

12 Claims, 9 Drawing Figures

FIG. 1
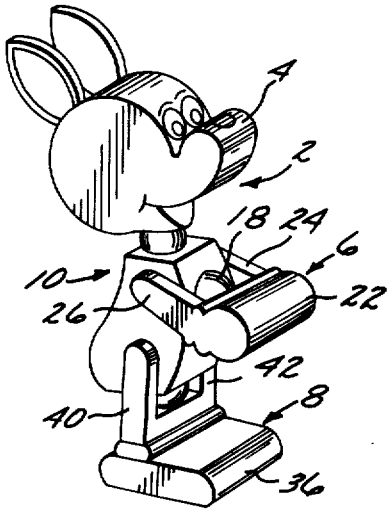
FIG. 2
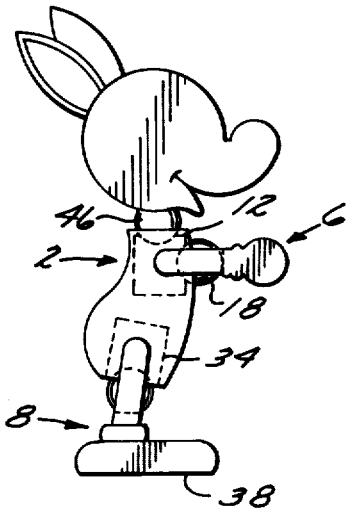
FIG. 3
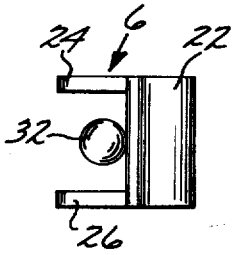
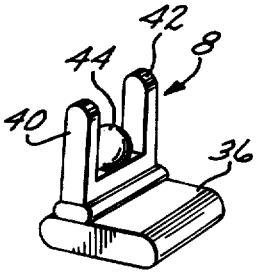
FIG. 4
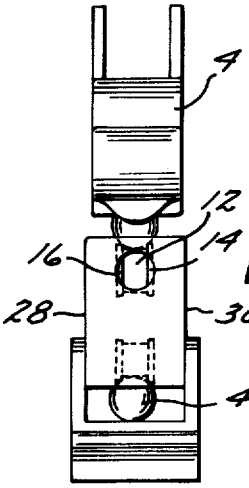
FIG. 5
FIG. 9
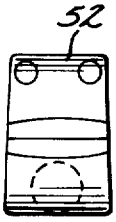
FIG. 6
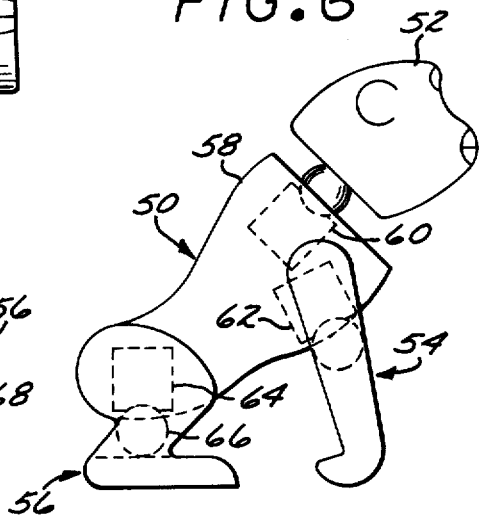
FIG. 7
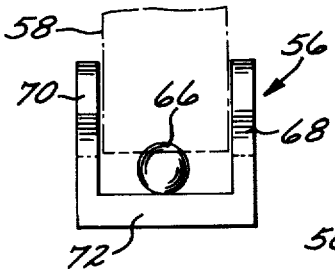
FIG. 8
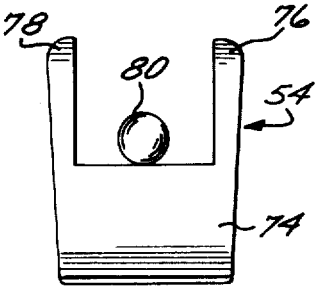

MAGNETIZED TOY WITH REMOVABLE APPENDAGES

BACKGROUND OF THE INVENTION

1. Field of the Invention

The present invention is directed to an articulated magnetized toy and more particularly to a versatile toy that is suitable for preschool children.

2. Description of the Prior Art

The increased emphasis upon safety standards in the toy industry has resulted in the production of toy items wherein sharp edges, dangerous paints and chemicals and sharp wires and fasteners have been eliminated. Frequently, the attempt to redesign old toys or to design new toys that meet these safety standards results in a less attractive toy with limited play options.

The problem of child safety is particularly acute with preschool children. With children of this age, it is necessary not only to accommodate the above safety problems, but the individual component parts of any toy should be large enough to prevent ingestion by the child. Further complicating the design requirements for the toy designer is the fact that children between the ages of 2 to 6 have a limited attention span and that while toys must be correspondingly simple, they should be extremely versatile to provide a large number of play options to keep the child's interest.

Various examples of magnetized structures in the toy industry can be found in the Gordon U.S. Pat. No. 3,090,155, Younkers U.S. Pat. No. 2,970,388 and Satoh U.S. Pat. No. 4,038,775. The prior art is still seeking to optimize safe and versatile toys, particularly for younger children.

SUMMARY OF THE INVENTION

Articulated magnetized toys having one or more removable appendages is provided. The body of the toy can be subjectively configured to represent an animal, human, vehicle, etc. Preferably, the body member is provided with flat sides. Magnetic means are provided within the body member for movably retaining articulated appendages. The appendages advantageously have U-shaped configurations that include an enlarged lower base member and a pair of upright members extending purposely on either side of the body member. The base member is purposely wider than the body member and the upright members can be configured and positioned relative to the body member to simulate, for example, a pair of arm or leg appendages. Means are provided on the appendage base member for interconnecting with the magnetic means in the body member such as a spherical joint. A plurality of appendage members having U-shaped configurations can be utilized and the appendages can be interchangeable. Thus, a child has a number of play options and can utilized individual appendages that can represent, for example, both limbs of an animal doll such as the feet and arms while still having a size significantly large to prevent ingestion by a child. The particular configurations of the appendages lessens the number of separate individual component parts that are necessary to create the visual simulation and play option of articulated creatures. Since the appendages are removable, accessory toy items can be appended to the body and various subcombinations of toy assemblies are possible, limited only by the imagination of a child.

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

BRIEF DESCRIPTION OF THE DRAWING

FIG. 1 is a perspective view of an articulated toy of the present invention;

FIG. 2 is a side view of an articulated toy of the present invention;

FIG. 3 is a plan view of an arm appendage;

FIG. 4 is a front side perspective view of a leg appendage;

FIG. 5 is a front view of an articulated toy of the present invention;

FIG. 6 is a side view of another embodiment of the present invention;

FIG. 7 is a front view of the leg appendage of FIG. 6;

FIG. 8 is a front view of the arm appendage of FIG. 6; and

FIG. 9 is a front view of the head appendage of FIG. 6.

BRIEF DESCRIPTION OF THE PREFERRED EMBODIMENTS

The following description is provided to enable persons skilled in the toy industry to make and use the invention and sets forth the best modes contemplated by the inventors of carrying out their invention. Various modifications, however, will remain readily apparent to those skilled in the art, since the generic principles of the present invention have been defined herein specifically to provide a toy assembly that can be manufactured in a relatively economical manner. The mode of the present invention specifically described in the accompanying drawings is in the form of various animals. Variations of this design structure to provide other forms of toy designs within the parameters of the present invention is quite possible.

Referring to FIG. 1, an articulated toy assembly in the form of a toy animal doll is disclosed. The toy animal doll 2 consists of essentially four component parts. These component parts can be formed from plastic or any other applicable material and can be subjectively configured. Thus, a body member 10 can be joined with removable and articulated appendages such as the head appendage 4, the arm appendage 6 and the leg appendage 8.

Mounted within the body member 10 is one or more magnets, such as magnet 12 that is sandwiched between a pair of armature plates 14 and 16. The respective armature plates can have bevelled arcuate edges that are designed to interface with a spherical magnetizable ball joint 18 as shown in the first embodiment of the invention shown in FIGS. 1 through 5. The chest portion of the body member 10 secures the armature plates 14 and 16 about the magnet 12. A pair of arcuate joints are provided on the same armature plates 14 and 16 and are positioned on the body member to receive respectively the ball joint 20 of the head appendage 4 and the ball joint 18 of the arm appendage 6. As can be readily appreciated, one or more magnets could be utilized in the body member having one or more connection joints provided on its armature plates depending upon the particular body configuration. Thus, in FIG. 2 two separate magnetic means are provided, though it should be readily understood that a large single magnetic means could be utilized to connect each of the three articulated appendages.

The particular shape of the arm appendage 6 and the leg appendage 8 and its relationship with the body member 10 are important to the present invention. Each of the support appendages have a U-shaped configuration which includes an enlarged base member and a pair of upright members. Thus, the arm appendage 6 which is shown in FIG. 3 has a base member 22 that simulates the hands of the toy animal. The width of the base member 22 is wider than the body member 10. Cantilevered from the base member 22 is a pair of upright members 24 and 26 that are configured and positioned on the base member to simulate a pair of arms. As can be seen from FIG. 1, these arm members 24 and 26 extend about and encompass the respective flap parallel sides 28 and 30 of the body member 10.

A spherical joint 32 is positioned on the base member 22 within the arm upright members 24 and 26. The spherical joint 32 is positioned equidistant from each arm upright member 24 and 26 and is adapted to magnetically connect with the magnet 12 and armature plates 14 and 16 within the chest cavity of the body member 10. As can be appreciated, the arm appendage 6 is subjectively positionable on the body member 10 within a limited pivotal degree of movement in the vertical direction.

In a manner similar to the connection of the arm appendage with the magnet within the chest cavity of the body member 10, a lower magnet assembly 34 can removably fasten the leg appendage 8 to the body member 10. A perspective view of the leg appendage 8 is shown in FIG. 4 and includes an enlarged foot base member 36 having a flat underside 38 for interfacing with a surface to support the toy animal doll 2 in an upright position. A pair of leg upright members 40 and 42 are configured and positioned on the foot base member 36 to simulate a pair of legs. Again, the foot base member 36 is wider than the width of the body member 10 and the leg upright members 40 and 42 are cantilevered to extend upward along either side of the body member 10 when the leg appendage 8 is magnetically coupled to the body member 10.

As can be seen in FIGS. 4 and 5, the leg appendage member 8 includes a spherical joint 44 that is attached to the foot base member 36 at a position equidistant from both leg upright members 40 and 42. Again, the leg appendage 8 is relatively pivotable in a unidirection about the body member 10. The foot base member 36 is large enough to provide a stable platform for supporting the toy animal doll 2 in an upright position.

As can be readily appreciated, the particular U-shaped configurations of the arm appendage 6 and leg appendage 8 serve the function of two or more individual subcomponent parts by simulating a pair of arms and legs with respective hands and feet. The size of these appendage subcomponent parts are large enough to prevent ingestion by a relatively small child and thereby eliminate a safety health hazard. The interchangeability of these appendages increases the play options available to the child.

The head appendage 4 is removably attached to the body member 10 through a spherical joint member 46. As can be readily appreciated, the head appendage 4 is relatively rotatable on the body member 10 to assume any life-like position.

An alternative embodiment of the present invention is disclosed in FIG. 6 wherein a simulated gorilla animal doll 50 is disclosed. Like the first embodiment, the gorilla toy assembly comprises four subcomponents, a head member 52, arm member 54, leg member 56 and a body member 58.

The body member 58 has a plurality of magnetic assemblies 60, 62 and 64 to respectively retain the various appendage members as can be seen from FIG. 6 when the cutout portion discloses the interface of the armature plates associated with the magnetic assembly 64 and the spherical joint 66 on the leg member 56.

Referring to FIG. 7, a front view of the leg member 56 is disclosed. As can be readily seen, the characteristic U-shaped configuration includes a pair of simulated leg members 68 and 70 attached to an enlarged foot base member 72. The width of the foot base member 72 relative to the width of the body member 58 permits the individual leg appendages to extend upward along the side of the body member 58 to simulate a lifelike nexus with the body member 58. Again, the size of the base member 72 is large enough to provide a stable platform to permit the gorilla doll 50 to assume a vertical position.

The arm member 54 likewise has an enlarged forearm and hand base member 74 as shown in FIG. 8 that respectively supports upright arm appendages 76 and 78. Again, a spherical joint member 80 is provided on the hand base member 74 to permit a magnetic connection with the body member 58.

As can be readily appreciated, the appendage members on both the first and second embodiment of the present invention could bde interchanged so that the first embodiment shown in FIGS. 1 through 5 could have gorilla legs and arms, and the second embodiment shown in FIGS. 6 through 9 could have the legs and arms of the first embodiment.

Thus, a highly versatile articulated magnetized toy is provided that permits the child to reconfigure one or more toys as desired with a minimal number of appendaged members. The individual appendage members have a U-shaped configuration that are safe for use with small children. As can be readily appreciated, the first and second embodiments disclosed herein are merely suggestive of possible toy designs and other variations of these designs would be readily apparent to a person skilled in this field from the present disclosure. For example, the body member can take the form of a chassis of a vehicle and the appendages can simulate wheel mountings.

Since various modifications would be possible to a person skilled in this field, the present invention should be measured solely from the following claims wherein we claim.

What is claimed is:

1. An articulated magnetized toy having at least one removable appendage comprising:

a body member;

magnetic means operatively positioned within the body member for removably retaining an articulated appendage, and a unitary appendage connected to the magnetic means having a U-shape configuration including a base member having means for interconnecting with the magnetic means and a pair of upright members extending on either side of the body member, the pair of upright members being disposed to at least partially surround the body member.

2. The invention of claim 1 wherein the body member has flat sides, the upright members interfacing with the flat sides.

3. The invention of claim 1 wherein the body member is configured to simulate a toy doll body and the appendage is configured and positioned on the body member to simulate a pair of legs, the upright members respectively interfacing with either side of the body to simulate a respective leg.

4. The invention of claim 3 wherein the means for interconnecting with the magnetic means includes a spherical joint.

5. The invention of claim 3 further including second magnetic means in the body member and a second appendage having a U-shape configuration, including a base member having means for interconnecting with the second magnetic means and a pair of upright members, the second appendage is configured and positioned on the body member to simulate a pair of arms.

6. The invention of claim 5 wherein each magnetic means includes a separate pair of magnetic pole pieces and a magnet positioned between the respective pole pieces.

7. The invention of claim 5 wherein the body member has flat sides, the upright members of the first and second appendages interface with the flat sides and the means for interconnecting with the respective magnetic means includes a spherical joint member on each appendage.

8. An articulated magnetized toy simulating a living creature having at least one removable appendage comprising:

a body member having at least a pair of approximately flat parallel sides;

magnetic means operatively positioned within the body member to provide a magnetizable joint, and a U-shaped appendage having a lower enlarged base member of greater width than the body member, the base member being connected to the magnetic means, the base member being capable of supporting the body member in a vertical position, the base member being configured to simulate a pair of feet, and a pair of upright members extending from the base member upward on either side of the body member, each upright member is configured and positioned relative to the body member and base member to simulate a respective leg.

9. The invention of claim 8 further including a second appendage configured and removably positioned on the body member to simulate a head and a third U-shaped appendage having an enlarged base member of greater width than the body member, the enlarged base being configured to simulate a pair of hands and a pair of second upright members extending from the base member on either side of the body member, each second upright member is configured and positioned relative to the body member and base member to simulate a respective arm.

10. The invention of claim 9 wherein each enlarged base member further includes a spherical joint positioned an equal distance between the upright members so that each appendage can be interchangeably mounted on the body member.

11. A toy figure comprising:

a body member incorporating at least one permanent magnet, the permanent magnet comprising means for forming a plurality of arcuate joint assemblies; the body member having at least a pair of substantially flat substantially parallel disposed sides;

a leg appendage having a first base member to support the toy figure on a support surface, a pair of first upright members being disposed substantially perpendicularly to the first member, and a first magnetic connecting member attached to the first base member, the first connecting member being removably attached to a first arcuate joint assembly to form a first articulated joint, each of the first upright members being dimensioned to interface with one of the flat sides of the body members whereby the first base member simulates a pair of feet of the toy figure, and the first upright members simulate legs of the toy figure, and a fore limb appendage having a second base member disposed substantially transversely to the flat sides, a pair of second upright members being disposed substantially parallel with the flat sides, and a second magnetic connecting member attached to the second base member, the second connecting member being removably attached to a second arcuate joint assembly to form a second articulated joint, each of the second upright members being dimensioned to interface with one of the flat sides of the body member, whereby the second base member simulates a pair of hands of the toy figure and the second upright members simulate a pair of fore limbs of the toy figure.

12. The toy figure of claim 11 further comprising a head having a third magnetic connecting member, the third connecting member being removably attached to a third arcuate joint assembly to form a third articulated joint.

* * * * *